United States Patent [19]

Matsumoto

[11] 4,000,881

[45] Jan. 4, 1977

[54] SLOWDOWN ESCAPING APPARATUS

[75] Inventor: Kouichi Matsumoto, Tokyo, Japan

[73] Assignee: Matsumoto Kiko Co., Ltd., Tokyo, Japan

[22] Filed: June 19, 1975

[21] Appl. No.: 588,302

[52] U.S. Cl. ..... 254/157; 188/184; 254/190 R

[51] Int. Cl.[2] ..... B66D 5/04

[58] Field of Search ..... 254/157, 159, 154, 151, 254/190 R; 188/184, 185

[56] References Cited

UNITED STATES PATENTS

| | | | |
|---|---|---|---|
| 139,484 | 6/1973 | Talpey | 254/157 |
| 447,501 | 3/1891 | Wilson | 254/157 |
| 667,526 | 2/1901 | Hugh | 254/157 |
| 924,695 | 6/1909 | Sheeley | 254/157 |
| 1,541,590 | 6/1925 | Ryba | 254/157 |
| 2,382,228 | 8/1945 | Howell | 188/185 |

FOREIGN PATENTS OR APPLICATIONS

| | | | |
|---|---|---|---|
| 669,438 | 4/1952 | United Kingdom | 188/185 |

*Primary Examiner*—Robert J. Spar
*Assistant Examiner*—Donald W. Underwood
*Attorney, Agent, or Firm*—Woodhams, Blanchard and Flynn

[57] ABSTRACT

Apparatus which may be preliminarily attached to the outside elevated place of a hotel, department store or any other building or structure, whereby in case of an emergency such as a fire or earthquake a person suitably attaches his or her body to a rope and descends to escape to a safe place. A novel feature of the apparatus is that in the housing of the apparatus containing a braking mechanism, a rotational motion transmission mechanism and a rope-carrying grooved pulley, the braking mechanism includes a brake disk having a special shape and a plurality of brake shoes so that a positive braking action is ensured when the brake disk is rotated in either the forward direction or the reverse direction, that a partition plate is mounted to divide the housing into two chambers, one containing the braking mechanism and the other containing the rotational motion transmission mechanism, so as to prevent any dust from entering into the former chamber from the latter, and that means for removing the loop of a rope is provided in the chamber containing the grooved pulley.

2 Claims, 11 Drawing Figures

SLOWDOWN ESCAPING APPARATUS

In the past, escaping apparatus of many different forms and constructions have been developed, and a slowdown escaping apparatus provided according to the present invention may be classified as one of them. In view of the special way of using the escaping apparatus, such apparatus must meet many difficult requirements. In other words, since the apparatus is normally held in reserve and used only in emergencies, it is essential that firstly the apparatus must be operated positively in case of need despite of its nonuse of a long period of time, secondly the apparatus is required to ensure a 100 percent structural safety as a safety device, and thirdly the apparatus must be of the type that can be operated easily even in the confusion of an emergency.

As is well known in the art, the slowdown escaping apparatus is designed so that a person may be suitably attached to a rope and escape in a short period of time from a higher to a lower safe zone, and therefore the essential point in the structure of the apparatus is how to safely let out the rope. Thus, it is important to meet the previously mentioned requirements while giving a full consideration to this essential point.

On the other hand, the use of a rope unavoidably presents difficult problems in the construction of the slowdown escaping apparatus. Namely, since both ends of the rope that passes around a grooved pulley in the slowdown escaping apparatus extend downwardly therefrom, i.e., two rope portions appear from the apparatus, and people may alternatively use the two rope portions to let themselves come down and escape to a safe place, the apparatus must be capable of ensuring a positive braking action when either of the rope portions is used. Moreover drawing the rope into and out of the apparatus tends to permit the entry of dust into the apparatus, and moreover the long rope tends to make a loop or loops therein. With the slowdown escaping apparatus of the type heretofore known in the art (the general construction of the known type of the slowdown escaping apparatus will not be described since it is well known to those skilled in the art), it has been either difficult to perform such a positive braking function when either of the two rope portions is operated or it has been possible only through a considerable complication of the apparatus. Also much consideration has not been given to the problem of preventing the entry of dust and removing the loop of rope. That is, the principal considerations have been given to the braking mechanism itself and/or the rotational motion transmission mechanism itself, and the exclusion of dust and the removal of the loop of rope have been considered as problems of minor importance.

However, various experiments conducted by the inventor showed that by using a brake disk and brake shoes combined in a well devised manner so that the direction of movement of each brake shoe is made angular and moreover each brake shoe is angularly movable when the brake disk is rotated in either the forward direction or the reverse direction, it was possible to apply the required braking force positively and efficiently without requiring any complicated structure. On the other hand, no matter how well designed were the structure of the braking mechanism and/or the rotational motion transmission mechanism, the entry of dust resulted in inaccurate transmission of rotational motion. Moreover there were extreme instances wherein the braking function was impaired, thus giving rise to a dangerous condition and destroying the safety of operation. The failure to remove the loop of the rope imposed a heavy burden on the grooved pulley over which the rope passed and/or the guide rolls mounted in the vicinity of the grooved pulley, thus giving rise to the danger of causing damage to the guide rolls and causing the rope to slip off the guide rolls and the grooved pulley. The present invention is directed to an improvement wherein the conventional slowdown escaping apparatus is modified to provide a positive and efficient braking action and prevent the entry of dust and ensure easy removing of the loop of rope, thereby meeting the previously mentioned requirements for the slowdown escaping apparatus.

It is an object of the present invention to provide an improved slowdown escaping apparatus of the type employing a rope, which apparatus includes a braking mechanism whereby a positive and efficient braking function is always performed when the two portions of the rope hanging down from the apparatus are alternatively operated.

It is another object of the present invention to provide an improved slowdown escaping apparatus wherein the entry of dust is prevented to ensure efficient performance of a braking mechanism and/or a rotational motion transmission mechanism and thereby to eliminate any detrimental effect on the functioning of the mechanisms.

It is still another object of the present invention to provide an improved slowdown escaping apparatus wherein the entry of dust is prevented by separating that portion of the apparatus where the rope is drawn in and out from the remainder of the apparatus with a shielding member and in this way the chamber containing the braking mechanism and the rotational motion transmission mechanism is hermetically sealed.

It is still another object of the present invention to provide such a slowdown escaping mechanism having a modified shielding member whereby compensation is made for any slight displacement or shaking of the grooved pulley caused by the movement of the rope in and out of the apparatus, and thus the initially provided hermetic seal is maintained.

It is still another object of the present invention to provide such a slowdown escaping apparatus wherein the loop made in the rope is easily removed.

It is still another object of the present invention to provide such a slowdown escaping apparatus wherein a cover is mounted for the guide rollers provided at that portion of the apparatus where the rope is drawn in and out, whereby the rope is drawn in and out of the apparatus through the holes formed in the cover, and in this way any loop of the rope is squeezed and automatically removed by the holes in the cover as the rope is drawn in and out of the apparatus.

The above and other objects, features and advantages of the present invention will become readily apparent from considering the following detailed description taken in conjunction with the accompanying drawings.

The slowdown escaping apparatus according to the invention will now be described in greater detail with reference to the illustrated embodiments. The slowdown escaping apparatus broadly comprises a braking mechanism A, a rotational motion transmission mechanism B and a grooved rope pulley C.

Figure 1:
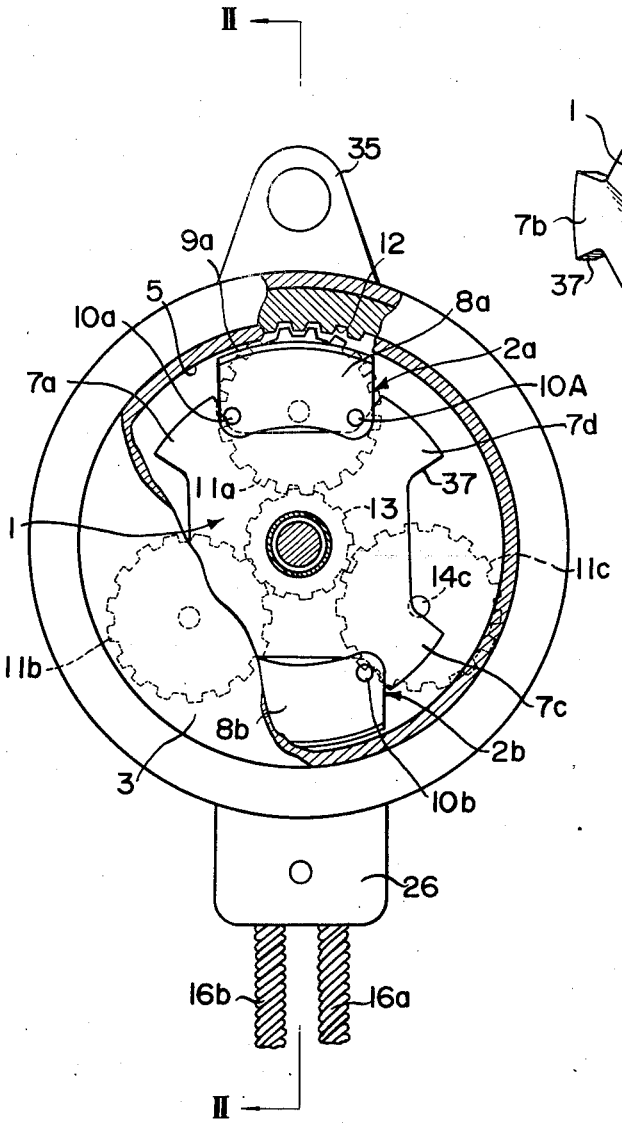
FIG. 1 is a front view of a slowdown escaping apparatus with a portion of the case broken away to show details of the braking mechanism.
Figure 4:
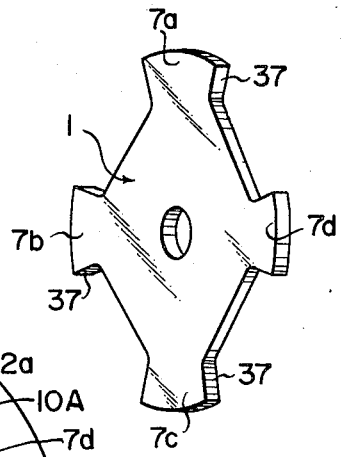
FIG. 4 is a perspective view of the brake disk used in the apparatus shown in FIG. 1.

The braking mechanism A includes a brake disk 1 and two centrifugal brake members 2*a* and 2*b* mounted on the brake disk 1, and these elements are positioned in place in a chamber 4 of a casing 3. The inner side portion of the casing 3 corresponding to the chamber 4 constitutes a brake drum 5. The brake disk 1 is mounted on a shaft 6 extending through the entire length of the apparatus, and the brake disk 1 is shaped so that it is formed with four radially projecting fishtailed or fan-shaped guide portions 7*a* to 7*d*, and the two centrifugal brake members 2*a* and 2*b* are movably fitted in the respective opposed recessed portions between the guide members 7*a* to 7*d*. The two centrifugal brake members 2*a* and 2*b* constituting brake shoes operatively associated with the brake drum 5 include respectively bases 8*a* and 8*b* each having an inverted U-shaped in section, brake linings 9*a* and 9*b* and paired pins 10A, 10*a* and 10B, 10*b*. The bases 8*a* and 8*b* are respectively provided with the paired pins 10A. 10*a* and 10B and 10*b* with each pair extending between the sides of the associated inverted U-shaped base. Consequently, when the centrifugal members 2*a* and 2*b* are oppositely arranged in the associated recessed portions of the guide members 7*a* to 7*d* as shown in FIG. 1, the paired pins 10A, 10*a* and 10B, 10*b* respectively come into contact with the associated side portions 37 of the guide portions 7*a* to 7*d* and the upper ends of the inverted U-shaped portions of the base portions 8*a* and 8*b* extend beyond the side portions 37 so that the centrifugal brake members 2*a* and 2*b* are arranged to span the brake disk 1 between the guide members 7*a* to 7*d*. This is the construction of the braking mechanism A which constitutes a first feature of the present invention. While, in the illustrated embodiment of this invention, only two centrifugal brake members are employed, the number of the centrifugal brake members is not limited to two and it is possible to use two pairs or four units of the centrifugal brake members. Further, the previously mentioned "fishtailed or fan-shaped" guide portions 7*a* to 7*d* means that the outer portion of each of the guide portions diverges out in both directions which intersect the radial direction and the width of its base portion is narrower than that of the outer portion.

On the other hand, the rotational motion transmission mechanism B is positioned in place in a chamber 36 of the casing 3 and it includes planetary gears 11*a* to 11*c*, an internal gear 12 and a pinion or sun gear 13. The planetary gears 11*a* to 11*c* are respectively rotatably attached by bolts 14*a* to 14*c* to one side of the grooved pulley C that will be described later. The internal gear 12 is secured to the inner side of the casing portion corresponding to the chamber 36 by means of bolts 15. The pinion gear 13 is mounted on the shaft 6 to become integral with the brake disk 1. The planetary gears 11*a* to 11*c* are positioned to mesh with the internal gear 12 and the pinion gear 13.

Figure 2:
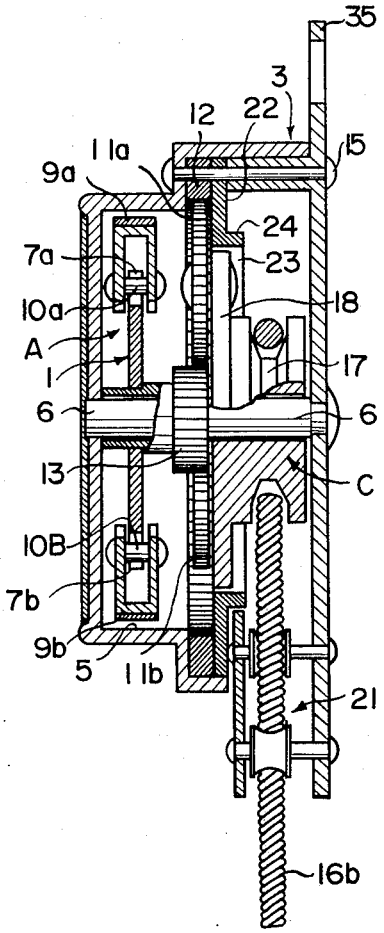
FIG. 2 is a sectional view taken along the line II—II of FIG. 1.
Figure 3:
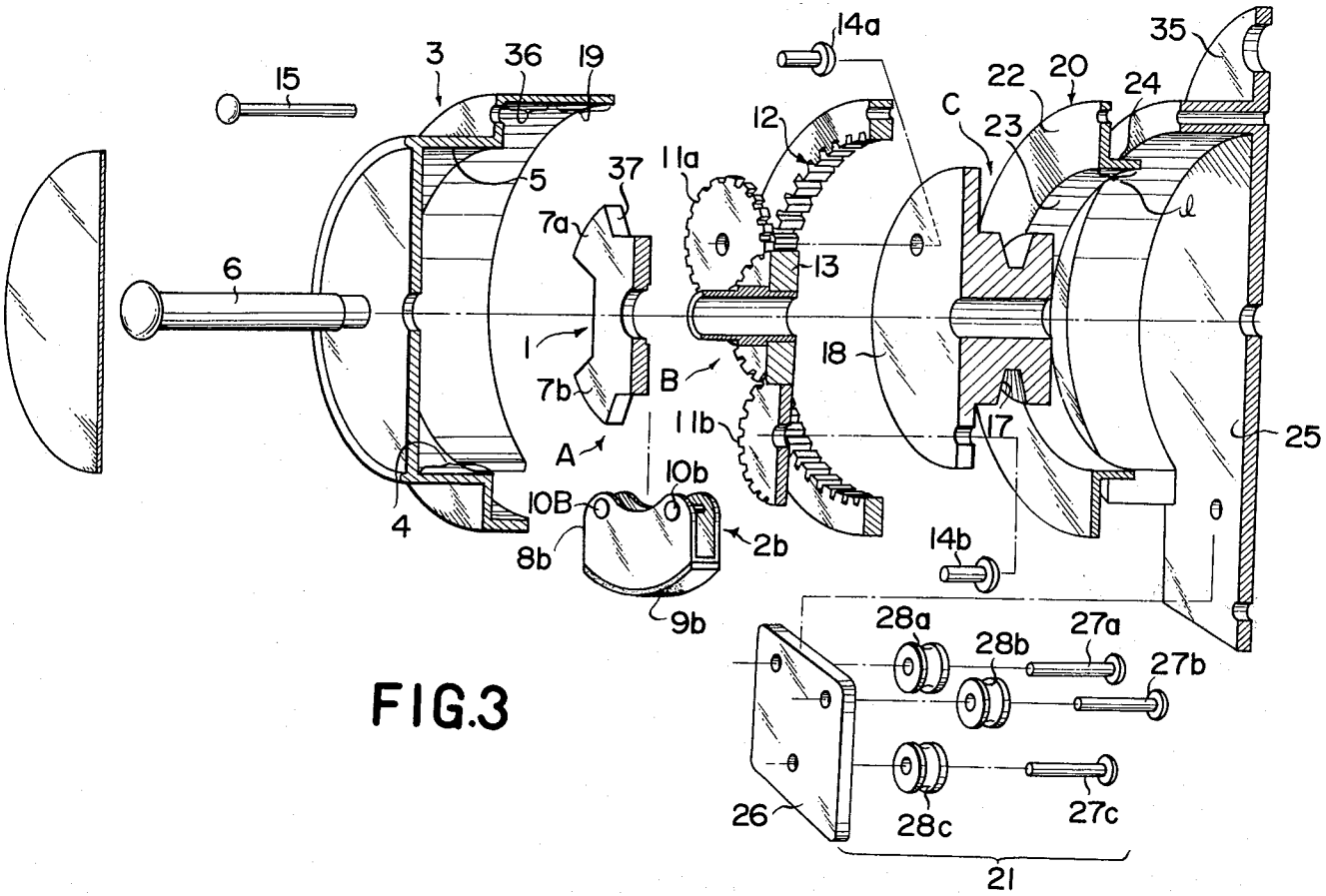
FIG. 3 is a perspective view showing the proper sequence and relationship in assemblying the various parts of the apparatus shown in FIG. 2.

As shown in FIGS. 2 and 3, the grooved rope pulley C includes a grooved rim 17 over which a rope 16 is passed and a mount 18 on which the planetary gears 11*a* to 11*c* are mounted. The grooved rope pulley C is mounted on the shaft 6 in such a manner that it is positioned in place in a chamber 19 of the casing 3. It should be noted that the term "grooved pulley" as used hereinabove and hereinafter comprises any of wheels of many different forms and structures over which the rope 16 may be extended and which is capable of positively converting the motion of the rope 16 into a rotational motion and transmitting it to other parts.

In addition to the above-described braking mechanism A, the rotational motion transmission mechanism B and the grooved rope pulley C, the slowdown escaping apparatus of this invention includes a shielding member 20 and a guide roller assembly 21 provided with loop removing means. A second feature of the present invention resides in the provision of these additional elements. The shielding member 20 is mounted in the casing 3 at the boundary of the chambers 19 and 36. The shielding member 20 includes a disk portion 22 and a flange portion 24 formed around a through hole 23. The flange portion 24 is arranged adjacent to the outer periphery of the planetary gear mount 18 of the grooved rope pulley C and has a dimension *l* so that the planetary gear mount 18 is not allowed to come out of engagement with the flanged portion 24 even when the grooved rope pulley C is slightly displaced on the shaft 6. While, in the illustrated embodiment, the flange portion 24 is made integral with the disk portion 20, it may be provided as a separate member.

Figure 7:
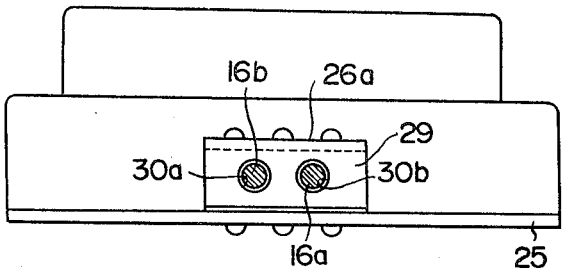
FIG. 7 is a bottom view of the slowdown escaping apparatus shown in FIG. 6.
Figure 6:
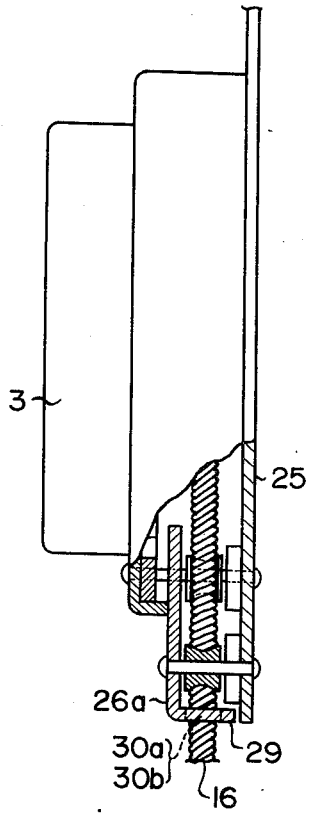
FIG. 6 is a side view showing another embodiment of the slowdown escaping apparatus with a part broken away to show the details of the principal portions.
Figure 8:
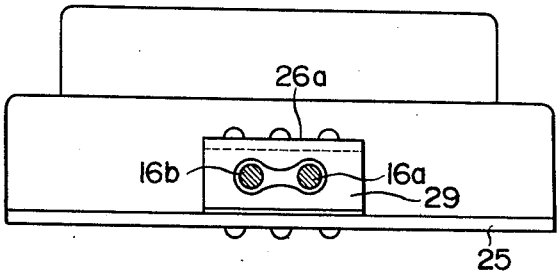
FIG. 8 is a bottom view showing a modified form of the embodiment shown in FIG. 7.
Figure 9:
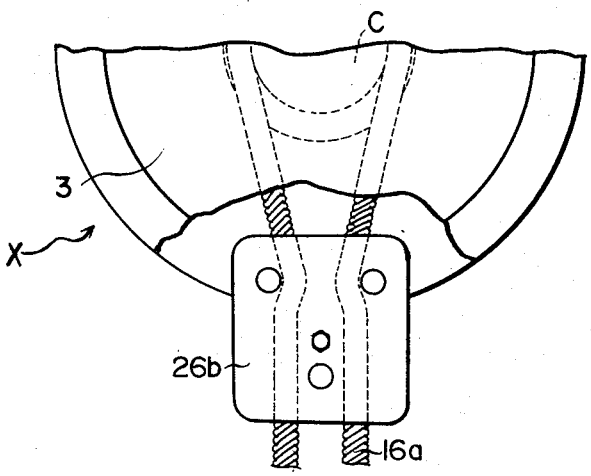
FIG. 9 is a front view showing a modified form of the slowdown escaping apparatus shown in FIG. 6 with a part broken away to show the details of the principal portions.
Figure 10:
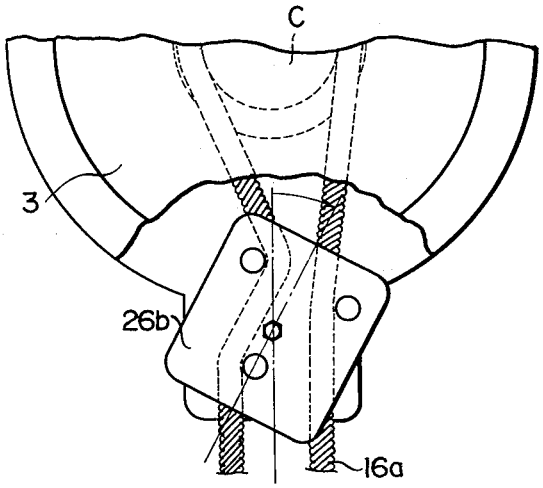
FIG. 10 is a schematic view for explaining the operation of the apparatus shown in FIG. 9.

The guide roller assembly 21 includes a base plate 25 of the casing 3, a roller cover 26 and three guide rollers 28*a* to 28*c* which are rotatably mounted between the base plate 25 and the roller cover 26 by means of bolts 27*a* to 27*c*. While, as shown in FIGS. 1 through 3, the base plate 26 is formed not to close that portion of the apparatus where the rope is drawn in and out, it may be formed as shown in FIGS. 6 through 8 to close that portion of the apparatus for removing the loop of rope. In other words, the roller cover 26 may be formed into an L shape whose bent horizontal portion 29 is formed with through holes 30*a* and 30*b* through which the rope 16 is drawn in and out. The through holes 30*a* and 30*b* may be formed separately as shown in FIG. 7, or alternately they may be formed to communicate with each other as shown in FIG. 8. With the rope holes 30*a* and 30*b* formed in the roller cover 26*a* in the manner described to pass the rope 16 therethrough, a loop 31 formed in the rope 16 may be removed as will be described later in greater detail. The roller cover 26 or 26*a* may be mounted on the base plate 25 of the casing 3 to provide a three-point support (FIGS. 1 to 3) or a single-point support (FIGS. 9 to 10). In the latter case, a roller cover 26*b* is slightly movable to prevent chafing of the rope.

Figure 11:
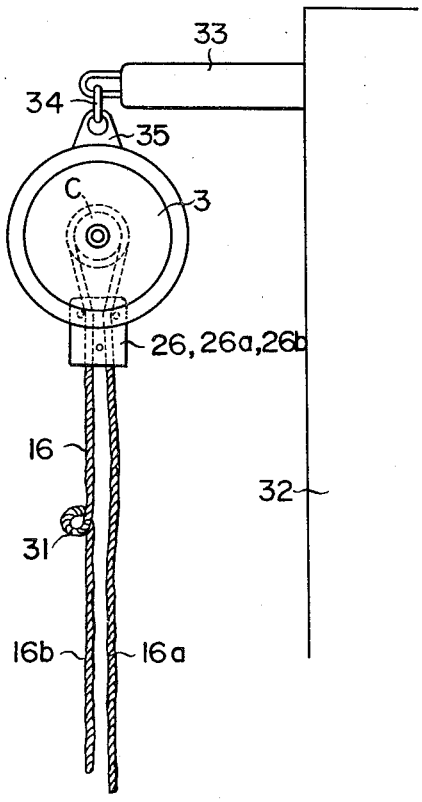
FIG. 11 is a schematic diagram showing the manner in which the slowdown escaping apparatus of the invention is used.
Figure 5:
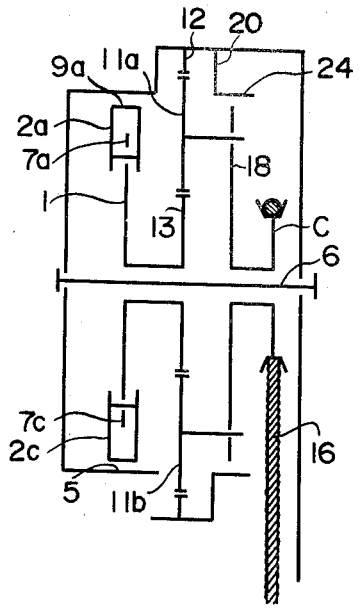
FIG. 5 is a schematic diagram of the gearing system showing the manner in which rotational motion is transmitted.

The operation of the slowdown escaping apparatus according to the present invention will now be described. In the first place, as shown in FIG. 11, a mounting support 33 is attached to the outside of a building 32 at a suitable elevated position and a shackle 35 of the slowdown escaping apparatus X is attached to the mounting support 33 with a retaining ring 34. In the slowdown escaping apparatus X, the rope 16 has been preliminarily extended to pass around the grooved pulley C through the guide roller assembly 21 so that two lengths 16*a* and 16*b* of the rope 16 hang down parallel to each other at the lower end of the slowdown escaping apparatus X. When a fire breaks out or an earthquake occurs, a person utilizes one of the rope portions 16*a* and 16*b* and goes down by means of a suitable attachment (e.g., a belt). (For continuous operation, the next person goes down by utilizing the other rope portion and therefter this process is repeated.) In this case, as the person goes down so that the rope 16 is moved, the grooved pulley C is rotated and consequently the planetary gear mount 18 is rotated to rotate the planetary gears 11*a* to 11*c* in mesh with the internal gear 12 as shown in the gear system diagram of FIG. 5. This in turn rotates the pinion gear 13 which is also in mesh with the planetary gears 11*a* to 11*c*. Consequently, the brake disk 1 which is integral with the pinion gear 13 is rotated and the side portions 37 of the guide portions 7*a* to 7*d* transmit the rotational motion of the associated centrifugal brake members 2*a* and 2*b* while engaging with their respective pins 10A, 10*a* and 10B, 10*b*. When this occurs, the brake linings 9*a* and 9*b* of the centrifugal brake members 2*a* and 2*b* come into sliding contact with the brake drum 5. As a result, the braking action is performed and the rope 16 is drawn out at a controlled speed only, thus permitting the person to descend safely.

Assuming now that the brake disk 1 is rotated in the clockwise direction in FIG. 1 by the movement of the rope 16, the brake disk guide portion 7*a* acts on the centrifugal brake member 2*a* and the guide portion 7*c* acts on the other centrifugal brake member 2*b*. In other words, the side portions 37 of the guide portions 7*a* and 7*c* come into contact with the pins 10*a* and 10*b* of the centrifugal brake member 2*a* and 2*b* and the centrifugal brake members 2*a* and 2*b* are urged in the clockwise direction. Since the centrifugal brake members 2*a* and 2*b* are subjected to a centrifugal force in addition to the urging force, the centrifugal brake members 2*a* and 2*b* are brought into contact with the brake drum 5. More specifically, in FIG. 1, the centrifugal brake member 2*a* is inclined with its right hand side being raised and the other centrifugal brake member 2*b* is inclined with its left hand side being lowered, and they are then pushed as such toward the brake drum 5 thus causing each of their brake linings 9*a* and 9*b* to be pressed against the brake drum 1 so as, as it were, to bite into the latter at an angle. Consequently, the resulting braking force is excellent. And this positive and efficient "braking action" is ensured when either one of the rope portions 16*a* and 16*b* is employed, that is, this braking force is equally obtainable satisfactorily when the brake disk 1 is rotated either in the clockwise direction or in the counterclockwise direction. On the other hand, the grooved rope pulley C transmits a rotational motion to the brake disk 1 through the planetary gears 11*a* to 11*c* and thus the rotational speed of the brake disk 1 is increased. And the braking action is effected more efficiently as the rotational speed of the brake disk 1 is increased.

Further, during the above-mentioned braking action, the centrifugal brake members 2*a* and 2*b* will not be caused to rock or shake in the backward and forward directions (in a direction normal to the plane of FIG. 1) as well as in the direction of movement of the brake disk 1 (in the circumferential direction of the brake disk 1), since the centrifugal brake members 2*a* and 2*b* are mounted to span the brake disk 1 and the position of each of the centrifugal brake members 2*a* and 2*b* is confined in the recessed portion between the projecting fan-shaped guide portions 7*a* to 7*d*. The effectiveness of this braking action will not be damaged in any way during a prolonged use of the slowdown escaping apparatus X.

In the above-described slowing down action, the shielding member 20 performs a very important action. In other words, the provision of the shielding member 20 has the effect of almost completely separating the chamber 19, where the rope 16 is drawn in and out of the slowdown escaping apparatus X, from the other chambers 36 and 4, and consequently the dust that enters from the outside into the chamber 19 along with the moving in and out of the rope 16 is prevented from entering into the chambers 36 and 4. In this way, the rotational motion transmission mechanism B and the braking mechanism A are always protected from dust and are allowed to perform their original functions effectively. In addition, when the grooved pulley C is caused to shake and shift on the shaft 6 by the movement of the rope 16, the shielding action is still maintained by virtue of the dimension *l* of the flange portion 24 of the shielding member 20.

The operation of the apparatus when the loop 31 is formed in the rope 16 will now be described. The term "loop" as used in the above and below descriptions has a broad meaning which includes any kinks and twists in a rope. Since the rope 16 of the slowdown escaping apparatus X is a long rope and a load is applied to only one of the two depending rope portions in actual use, the two depending rope portions tend to entwine with each other or twist and in an extreme case a loop is formed in the rope as shown in FIG. 11. In the case of the ordinary small and loose loop, the loop may be easily removed by means of the three guide rolls 28*a* to 28*c*. In the case of an extremely hard loop, many difficulties ensue. In accordance with the present invention, however, the rope 16 runs through the holes 30*a* and 30*b* in the roller cover 26*a* (or 26*b*) and consequently the rope 16 is squeezed as it passes through the holes 30*a* and 30*b* thus automatically and forcibly removing the loop 31. In this case, if the roll cover 26*b* of the guide roller assembly 21 is mounted on the base plate 25 to provide a single-point support as shown in FIGS. 9 and 10, the application of a load on one of the two rope portions causes the roller cover 26*b* to rotate (in the direction of the arrow in FIG. 10), and consequently that roll of the three guide rolls which contacts with the drawn out rope portion receives a reduced contact pressure. This ensures a longer life for the rope 16. Experiments conducted by the inventor showed that where the guide roller assembly shown in FIGS. 9 and 10 was used with the rope 16 made of cotton and a metal wire rope core of 6 mm in diameter which was covered with a hard cotton covering to obtain an outer diameter of 12 mm, the life of the rope was more than 3 times that of the rope used with a non-rotatable guide roller assembly and the rope did not wear easily.

It will thus be seen from the foregoing description that the slowdown escaping apparatus according to the present invention has a high degree of safety in operation, is highly reliable in operation over a long period of time and ensures a longer service life of the rope used, thus satisfactorily accomplishing its intended objects.

Having described my invention, what I claim as new and desire to secure by Letters Patent is:

1. In a slowdown escaping apparatus comprising a casing having a brake drum, rotational braking means disposed in the casing, said braking means including a brake disk and a plurality of centrifugal brake members engageable with the brake drum, rotational motion transmitting means disposed in the casing and connected to the brake disk and including a plurality of planetary gears, an internal gear and a pinion gear, a grooved rope pulley disposed in said casing and connected for transmitting rotational motion to said rotational motion transmitting means, and a rope extending around the pulley, whereby in case of an emergency a person supported on the rope can descend at a controlled speed, the improvement which comprises:

said brake disk has a plurality of pairs of circumferentially spaced-apart fan-shaped guide portions projecting therefrom and defining a plurality of circumferentially spaced recessed portions, each of said centrifugal brake members being movably positioned in one of said recessed portions and having a brake lining engageable with the brake drum, each of said centrifugal brake members including a U-shaped base spanning the brake disk, said base having a pair of legs extending toward the brake disk and an outer arcuate connecting web extending between said legs with said brake lining being mounted on said web, and a pair of pins extending between the legs of said base and adapted to contact the respective guide portions of the associated recessed portion, whereby when said brake disk is rotated in either a clockwise or a counterclockwise direction, the corresponding one of said pair of pins is pressed against the corresponding one of said guide portions and said brake lining is pressed against said brake drum.

2. In a slowdown escaping apparatus comprising a casing having a brake drum, rotational braking means disposed in the casing, said braking means including a brake disk and a plurality of centrifugal brake members engageable with the brake drum, rotational motion transmitting means disposed in the casing and connected to the brake disk and including a plurality of planetary gears, an internal gear and a pinion gear, a grooved rope pulley disposed in said casing and having a portion carrying said planetary gears for transmitting rotational motion to said rotational motion transmitting means, and a rope extending around the pulley, whereby in case of an emergency a person supported on the rope can descend at a controlled speed, the improvement which comprises:

a shield plate located in said casing and dividing same into a first chamber containing said grooved rope pulley and a second chamber separate from said first chamber and containing said braking means and said rotational motion transmitting means, said shield plate including an L-shaped flange portion arranged adjacent to the outer periphery of said portion of said grooved rope pulley carrying said planetary gears, said flange portion having a predetermined dimension whereby said portion of said grooved rope pulley remains within said L-shaped flange portion and dust in said first chamber is prevented from entering into said second chamber even when said grooved rope pulley is displaced axially.

* * * * *